United States Patent [19]

Kawazoe et al.

[11] Patent Number: 4,724,604

[45] Date of Patent: Feb. 16, 1988

[54] METHOD OF MANUFACTURING A PART WITH A COIL

[75] Inventors: Hiroshi Kawazoe; Tokuhito Hamane; Kiyotaka Sugiura, all of Osaka, Japan

[73] Assignee: Matsushita Electric Industrial Co., Ltd., Japan

[21] Appl. No.: 860,625

[22] Filed: May 6, 1986

[30] Foreign Application Priority Data

May 9, 1985 [JP] Japan ..... 60-98372

[51] Int. Cl.[4] ..... H01F 41/02

[52] U.S. Cl. ..... 29/606; 29/522 R; 29/73 G; 29/761; 29/596

[58] Field of Search ..... 29/596, 522 R, 598, 29/605, 606, 736, 761; 310/12-14, 35

[56] References Cited

U.S. PATENT DOCUMENTS

| | | | |
|---|---|---|---|
| 3,835,339 | 9/1974 | Laronze | 310/13 |
| 4,114,258 | 9/1978 | Beech | 29/596 |
| 4,578,604 | 3/1986 | Eilertson | 310/35 X |

OTHER PUBLICATIONS

Patents Abstracts of Japan, vol. 5, No. 179 (E-82) [851], 17th Nov. 1981; & JP-A-56 107 549 (Matsushita Denki Sangyo K.K.), 26-08-1981.

*Primary Examiner*—Carl E. Hall

*Attorney, Agent, or Firm*—Lowe, Price, Leblanc, Becker & Shur

[57] ABSTRACT

A method for fitting a ring coil in a channel formed in the inner circumference surface of a hollow cylindrical member comprises a step of deforming the ring coil by applying a force to one or more portions thereof radially outwardly. The deformation of the ring coil causes a reduction of the circumscribed circle diameter facilitating its insertion into the member. After the insertion, the deformed portions are respectively outwardly pressed so that the non-deformed portions are respectively engaged with the channel. Subsequently, the deformed coil is sequentially pressed to the bottom surface of the channel are around so that the deformed coil is returned to its original shape and the whole of the coil is perfectly fitted in the channel.

4 Claims, 21 Drawing Figures

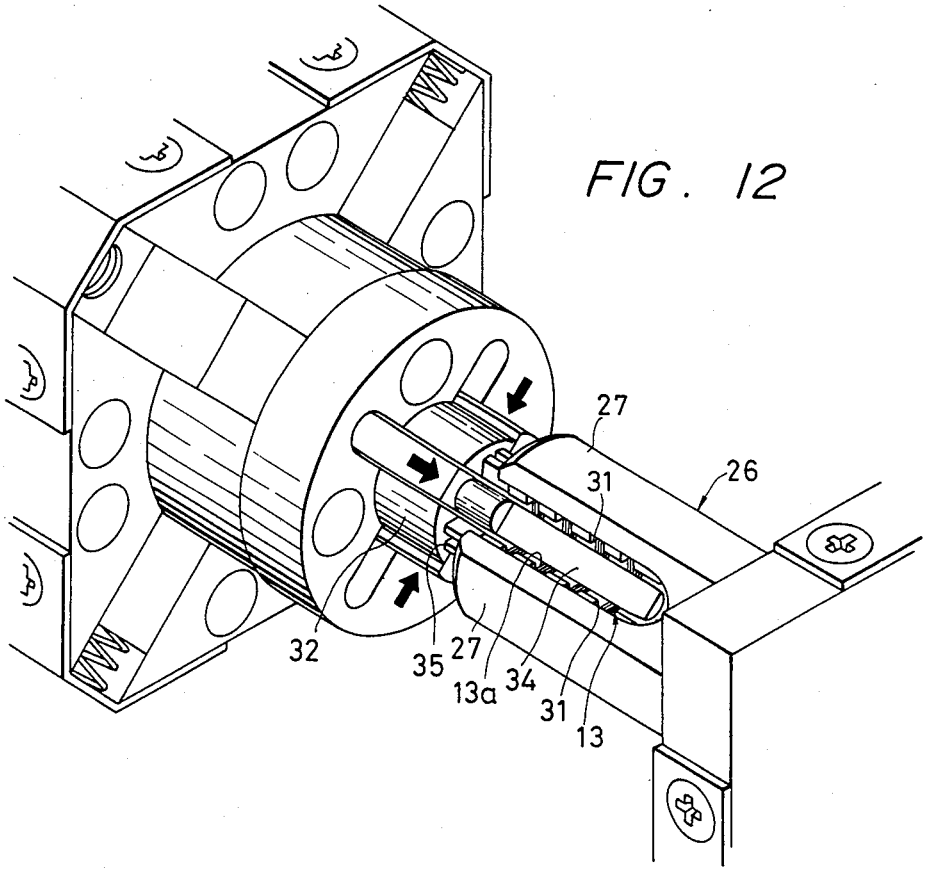
FIG. 12
FIG. 13
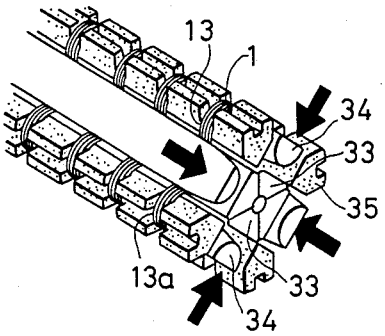
FIG. 14
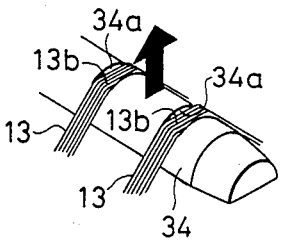

METHOD OF MANUFACTURING A PART WITH A COIL

BACKGROUND OF THE INVENTION

1. Field of the Invention

The present invention relates to a method for manufacturing a part with one or more coils, and in particular to a method for fitting at least one ring coil into a corresponding channel formed in the inner circumference surface of a hollow cylindrical member such as a cylindrical core of a rotary transformer employed for a video tape recorder.

2. Description of the Prior Art

Video tape recorders are being improved for size-reduction and multifunction purposes. A rotary transformer, being one of the main components of a video tape recorder, has been improved and a cylindrical rotary transformer has been proposed in place of the conventional plate-type transformer.

The cylindrical rotary transformer requires a hollow cylindrical core having one or more ring coils at the inside surface thereof. The ring coils should be received in channels formed on the inner circumference surface of the cylindrical core so as to prevent the coils from protruding inwardly with respect to the inner surface thereof.

To form such a cylindrical core, lead wires are in advance attached to the coils which will in turn be fitted into the coil channels formed in the inside circumference surface of the core. In this case, each of the ring coils is formed to have a diameter substantially equal to the channel diameter, i.e., greater than the inner diameter of the core, and then inserted into each of the channels making the most of elastic characteristic of the ring coil.

Such coil fitting work is complex and difficult and takes a long time with manual operation, making it difficult to ensure a sufficient production and to improve yield because of damage to the coil during fitting. These disadvantages tend to frustrate use of the cylindrical rotary transformer in video tape recorders.

SUMMARY OF THE INVENTION

An object of the present invention is therefore to provide a method which overcomes the disadvantages inherent in the prior art techniques and which is capable of accurately effectively fitting ring coils in coil channels formed in the inside circumference surface of a cylindrical core. This invention facilitates automatization for manufacturing a cylindrical rotary transformer and enables the cylindrical rotary transformer to be employed in a video tape recorder.

In accordance with the present invention, a method for fitting a ring coil into a channel formed in the inner circumference surface of a cylindrical and hollow member, comprises the steps of: deforming the ring coil by applying a force inwardly to one or more portions thereof so that the circumscribed circle diameter thereof becomes smaller; inserting the deformed coil into the hollow cylindrical member; pressing the deformed portions of the coil outwardly after positioning the deformed coil to match the channel so that the circumscribed circle diameter thereof is enlarged and the non-deformed portions of the coil are fitted into the channel; and pressing the coil to the bottom surface of the channel all around so that the whole of the coil is perfectly fitted therein.

According to the above-described manufacturing method of a part with one or more coils, the inward deformation of the ring coil causes the reduction of the circumscribed circle diameter thereof and enables the easy insertion of the deformed coil into the hollow cylindrical member such as a cylindrical core. Furthermore, it is possible to easily accurately locate the coil at the position opposed to a corresponding coil channel. The recessed portions of the located coil can be depressed outwardly without interfering with the inner surface of the core so that the circumscribed circle diameter is spread out to engage the non-deformed portions of the coil with the coil channel and the coil is thus maintained in the coil channel without using a special supporting member. This simplifies the process that the coil is in turn pressed to the circumference of the coil channel to return the same to its original configuration to perfectly fit therein.

In accordance with the present invention there is also provided an apparatus for manufacturing a part with a coil, comprising: a coil-wound shaft having a coil-positioning member on a circumference surface thereof; a coil-forming device for forming a coil by winding a wire around the coil-positioning member; a coil holder having a plurality of gripping jaws for gripping the coil-positioning member and holding the formed coil; a coil-deforming shaft having a plurality of coil-deforming finger bars for deforming the coil held by the gripping jaws by applying a force radially inwardly to one or more portions of the held coil; a coil-enlarging shaft having a plurality of enlarging finger bars for enlarging the deformed portions of the coil and a plurality of supporting bars for supporting non-deformed portions of the coil, the coil-enlarging shaft being inserted into a cylindrical and hollow member such that the coil is positioned to match a channel formed in the inner circumference surface thereof; and a pressing shaft having a roller for pressing the inserted coil to the bottom surface of the channel all around so that the whole of the coil is perfectly fitted therein.

The features of the present invention allow a cylindrical core with a coil to be easily efficiently produced with a fine yield, resulting in ease of automation for mass-production and facilitate the adoption of cylindrical rotary transformers for video tape recorders.

Another feature of this invention is to accurately fit the coil into the coil channel by preventing irregularity between the turns of coil wire caused during the coil fitting process.

To avoid the irregularity, according to the present invention, the coil turns are bonded to each other using, for example, an appropriate bonding agent.

A further feature of this invention is to concurrently fit a plurality of coils into a plurality of coil channels, for improved efficiency.

According to the present invention, a shaft is used for the coil fitting process on which a plurality of coils are wound at intervals equal to the intervals of a plurality of coil channels formed to align axially in the inner circumference surface of a cylindrial core.

BRIEF DESCRIPTION OF THE DRAWINGS

The objects and features of the present invention will become more readily apparent from the following detailed description of the preferred embodiments taken in conjunction with the accompanying drawings in which:

FIG. 3 is a perspective view showing the step of deforming several portions of the coil by applying a force radially inwardly;

FIG. 4 is a diagram illustrating the step of depressing outwardly the portions of the coil deformed in the step of FIG. 3 in order to fit and maintain non-deformed portions of the coil in a coil channel formed in the inner circumference surface of the cylindrical core;

FIG. 5 is a perspective view illustrating the step of sequentially pressing the coil to the bottom surface of the coil channel after the step of FIG. 4;

FIG. 6 is an illustration of the step of FIG. 3 and a detailed example of the step of inserting the coil into the cylindrical core;

FIG. 7 is an illustration of an example of the step of enlarging the coil of FIG. 6 to fit and maintain the non-deformed portions of the coil in the coil channel;

FIGS. 8 through 21 illustrate the detailed steps of the case of fitting a plurality of coils into a plurality of coil channels formed in the inner circumference surface of a cylindrical core, of these:

FIG. 8 is a perspective view showing the step of forming a predetermined number of coils by means of a coil-forming device;

FIG. 9 is a perspective view illustrating the step of heating the coils so that the wires of each of the coils are bonded each other;

FIG. 10 is a perspective view illustrating the step of transferring the plurality of coils formed in the step of FIG. 9 to a jaw type coil holder;

FIGS. 11 and 12 are perspective views showing the step of transferring the coils from the jaw type coil holder to a coil-deforming shaft having a plurality of outside finger bars;

FIG. 13 is an illustration of the condition after the coils are transferred into the coil-deforming shaft;

FIG. 14 is an illustration of a coil deformation by the finger bar;

FIG. 15 is a perspective view showing the condition that the coils are inserted into a hollow cylindrical core;

FIG. 16 is a perspective view showing the step of depressing the deformed portions of each of the coils outwardly to fit and maintain the non-deformed portions thereof in the coil channel of the core;

FIG. 17 is a perspective view showing the condition that the deformed portions are pressed outwardly by an inside finger bar;

FIG. 18 is a perspective view illustrating the condition that the non-deformed portions of each of the coils are respectively fitted and maintained in the coil channels by the step of FIG. 17;

FIGS. 19 and 20 are perspective views showing the step of inserting a coil-enlarging shaft into the core to further spread the coils; and FIG. 21 is a perspective view showing the step of sequentially pressing all portions of the coils into the coil channels to perfectly fit the coils therein.

DETAILED DESCRIPTION OF THE INVENTION

Figure 1:
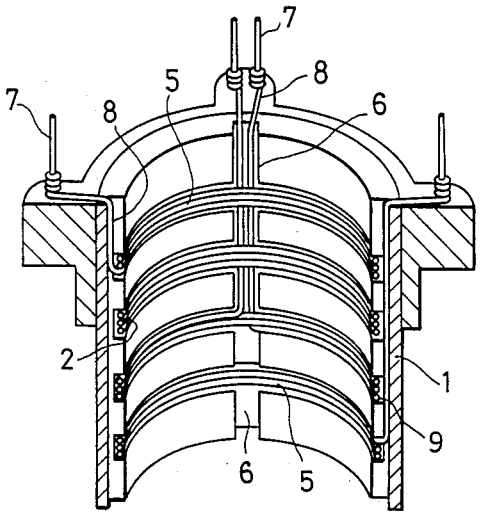
FIG. 1 is a perspective and longitudinal cross-sectional view of a cylindrical core of a rotary transformer to be manufactured in accordance with a manufacturing method according to the present invention.
Figure 2:
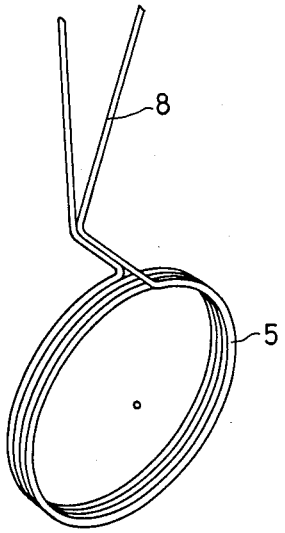
FIG. 2 is an illustration of a ring coil fitted in a coil channel formed in the cylindrical core of FIG. 1.

Referring now to FIG. 1, there is illustrated a cylindrical rotary transformer including a core 1 having a plurality of ring coils 5 which are provided in a plurality of channels 2 formed in the inner circumference of the core 1 at axial intervals. FIG. 2 shows one of the ring coils. Lead wires 8 of the ring coils 5 are respectively guided through channels 6 to terminal pins 7 provided at one end of the core 1 and respectively wound therearound. An important problem in the structure of the cylindrical rotary transformer relates to the need for the ring coils 5 and the lead wires 8 which should be perfectly fitted in the coil channels 2 and lead wire channels 6 without projecting inboard with respect to the inner surface of the core, because the provision of a stator, not shown, will be made in the core 1 wherein a gap betweem them is very small.

Figure 3:
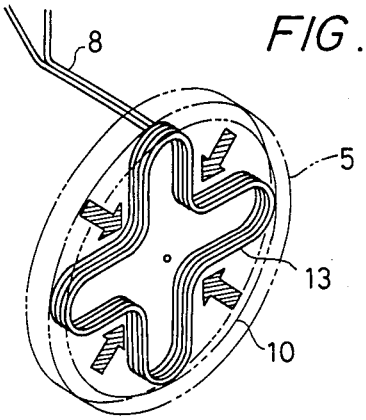
FIGS. 3 through 7 show the main steps of an embodiment of the present invention, of these.

According to an embodiment of the present invention, first, a self-welding wire is wound to form a coil 5 as shown in FIG. 2 which has an outer diameter substantially equal to the diameter of the coil channel 2 defined in the cylindrical core 1, and which is in turn heated electrically or with hot blast to bond the wire turns of the coil 5 adjacent to each other. It is also appropriate to use an adhesive material for the adhesion. The coil 5 thus bonded is deformed by applying a force to several portions (four portions in the figure) in the direction of the center of the coil 5, i.e., inwardly, so that a substantially crossshaped coil 13 is formed as shown in FIG. 3. The deformation is performed such that the diameter of the circumscribed circle 10 of the cross coil 13, indicated by a dash-line in the figure, is smaller than the inner diameter of the cylindrical core 1.

Figure 4:
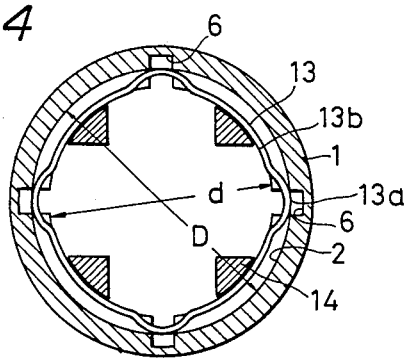
Figure 5:
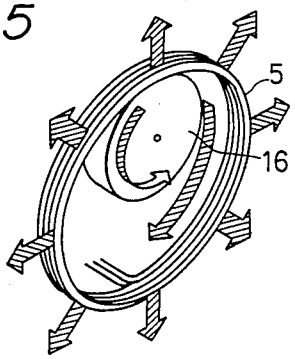

Secondly, as shown in FIG. 4, the cross coil 13 is inserted into the core 1 and positioned in opposed relation to the coil channel 2, i.e., to match the channel 2, and then the deformed portions of the cross coil 13 are respectively pressed outwardly by means of inside finger bars 14 so that the non-deformed portions 13*a* of the coil 13 are respectively engaged with the coil channel 2. In this process, the deformed portions 13*b* are enlarged only up to the inner diameter D of the core 1, which is indicated by the reference character d, because the finger bars 14 interfere with the inner surface therteof. Thereafter, the coil 13 is returned to its original configuration by means of a pressing roller 16 as illustrated in FIG. 5, which acts to press the coil 13 from the inboard sides to the bottom surface of the channel 2 with its rotation. The function of the pressing roller 16 results in perfectly fitting the coil 5 in the coil channel 2. The pressing roller 16 has a diameter smaller than the inner diameter of the core 1 and a width substantially equal to the width of the coil 5, 13 or 13, the axial width of the pressing roller 16 being smaller than the width of the coil channel 2.

Figure 6:
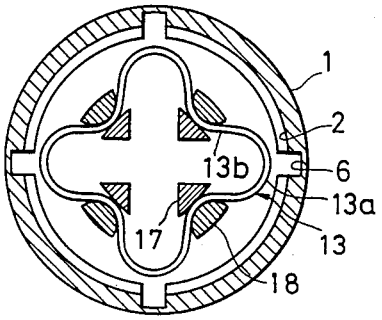
Figure 7:
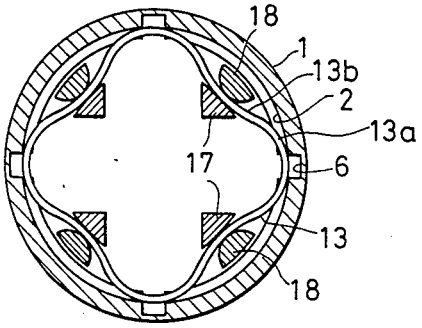

FIGS. 6 and 7 are illustrations of an example of the deformation and spread of the coil 5 (or 13) by means of outside finger bars 18 and inside finger bars 17, a pair of which are disposed to face each other with the deformed portions between. The outside finger bars 18 function to deform the portions of the coil 5, whereas the inside finger bars 17 act to spread the deformed portions thereof. Generally, after the deformation of the coil has been performed by applying an external force thereto, by removing the external force the deformed portions are somewhat returned due to spring back. It is therefore required that the coil be deformed in anticipation of the spring back amount. According to the arrangement shown in FIGS. 6 and 7, in the case the coil 13 is inserted without removing the external force applied by the outside finger bars 18, there is no requirement to anticipate the spring back, reducing a strain developed by the coil deformation because it is not required that the deformation is made in excess of the necessary amount. Furthermore, the inside finger bars 17 and outside finger bars 18 always put the deformed portions of the coil 13 therebetween, thereby making easy to the positioning of the coil 13.

As shown in FIG. 7, after the insertion of the coil 13 into the core 1 and the positioning thereof, the deformed portions 13*b* are pressed outwardly by the inside finger bars 17 so that the non-deformed portions 13*a* are engaged with the coil channel 2. Thereafter, the inside finger bars 17 and the outside finger bars 18 are removed, followed by the process of FIG. 5.

FIGS. 8 through 21 illustrates the detailed steps of the case of fitting a plurality of coils into a plurality of coil channels formed in the inner circumference surface of a cylindrical core.

Figure 8:
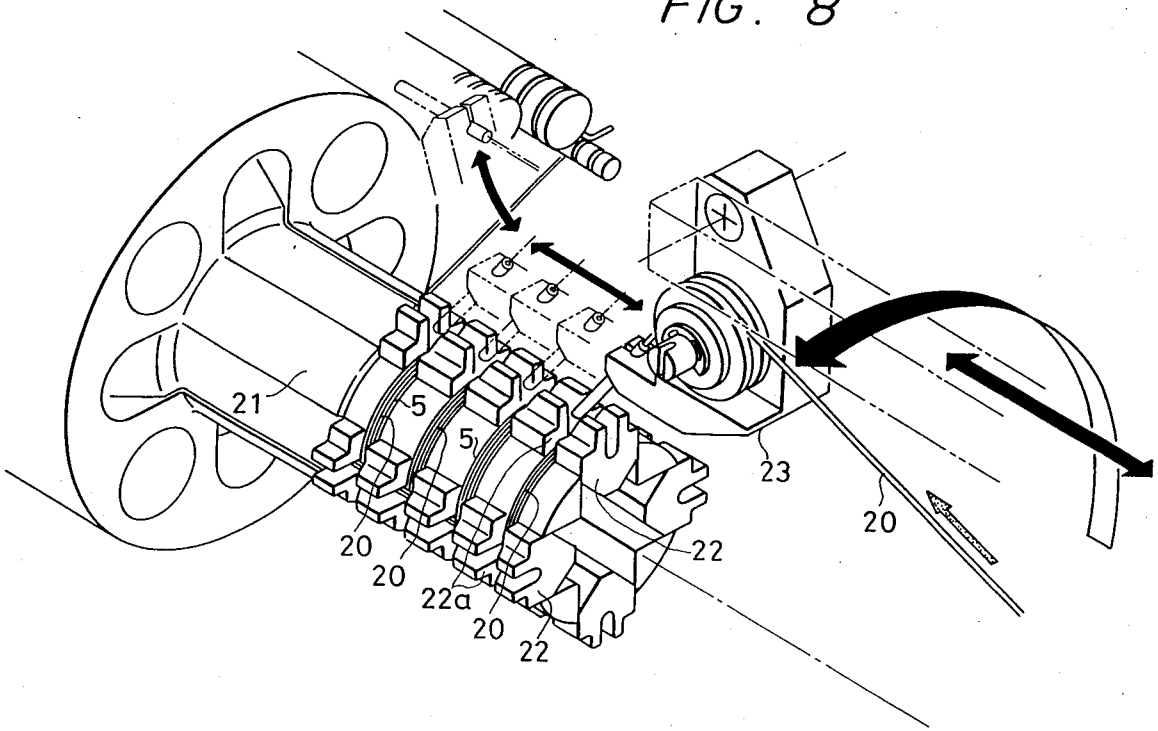

FIG. 8 shows the step of forming a plurality of coils 5. A wire 20 is wound around a coil-positioning member 22 attached to a coil-forming shaft 21 so that a plurality of coils 5 are formed by a predetermined number at equal intervals. The coil-positioning member 22, as shown in the figure, has an irregular configuration, the recess-portions 22*a* of which are arranged axially at equal intervals. The wire 20 is wound around the recess-portions 22*a* by a winding device 23, thereby making possible to form a plurality of the coils at equal intervals.

Figure 9:
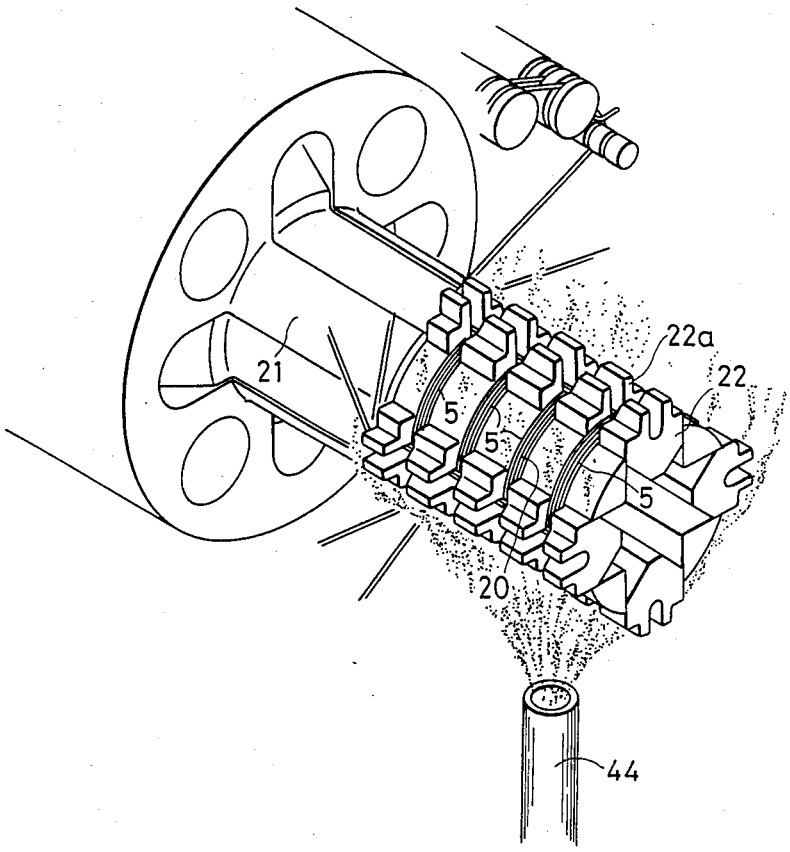

The coils 5 thus formed, as shown in FIG. 9, are heated by hot air 25 from a nozzle 24 in order to melt an adhesive layer coated on the wire 20. Thereafter, the heating is stopped and the coils are cooled to achieve the bonding between the turns of each of the coils 5.

Figure 10:
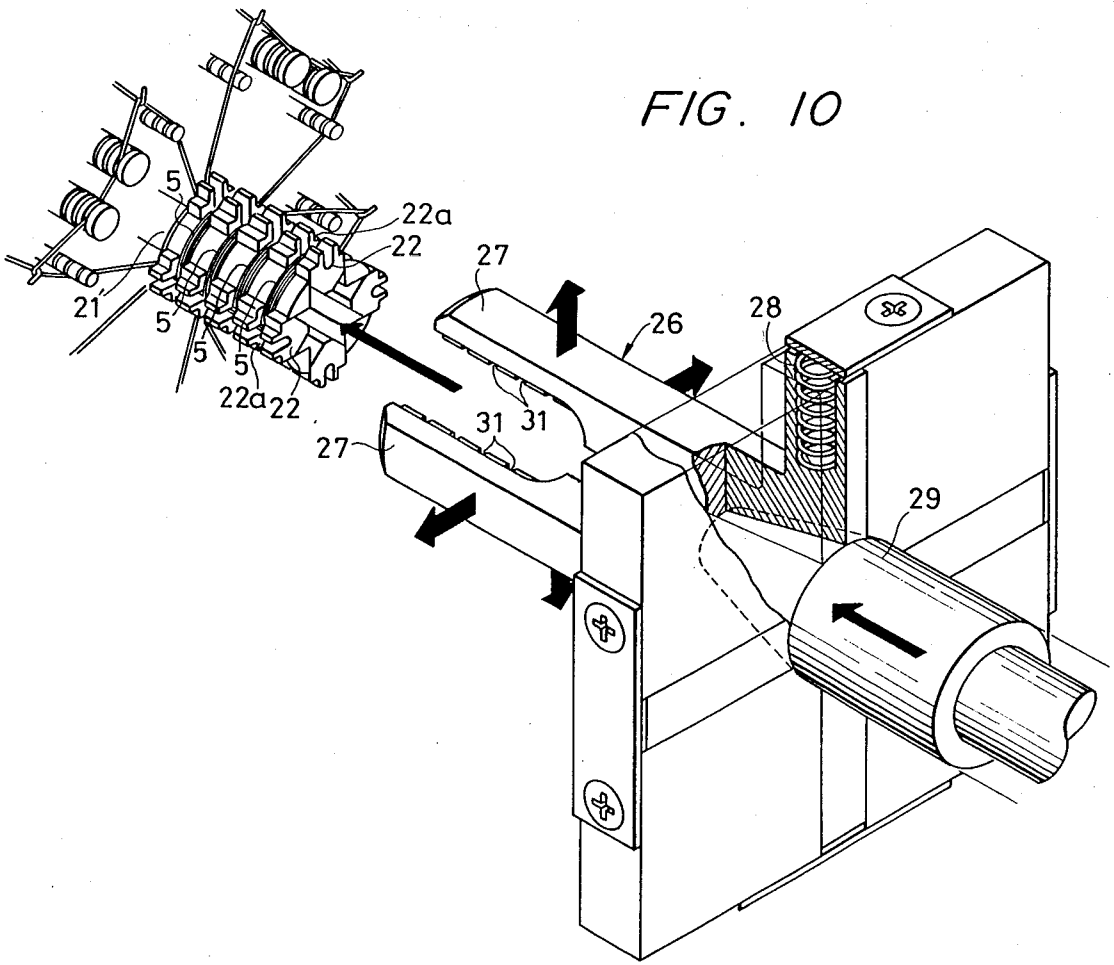

After the heating and cooling processes, the coils 5 are transferred to a jaw type coil holder 26 as shown in FIG. 10. The coil holder 26 includes coil-gripping jaws 27 which are always biased by springs 28 in the direction of gripping and which are spread by the actuation of a pushing bar 29. The coil-gripping jaws 27 are arranged to be positioned to cover the coil-positioning member 22 with the condition of spread and then grip the coil-positioning member 22 by biasing force of the springs 28 in response to the de-actuation of the pushing bar 29. As a result of the gripping of the coil-positioning member 22, it is pressed and moved in the inboard direction, i.e., in the direction that the circumscribed circle diameter thereof is reduced, so that the coils 5 are respectively received in coil-gripping channels 31 formed at the inside of the coil-gripping jaws 27 whose number is equal to the number of the coils 5. Thereafter, the coil-gripping jaws 27 pull out only the coils 5 from the coil-positioning member 22.

Figure 11:
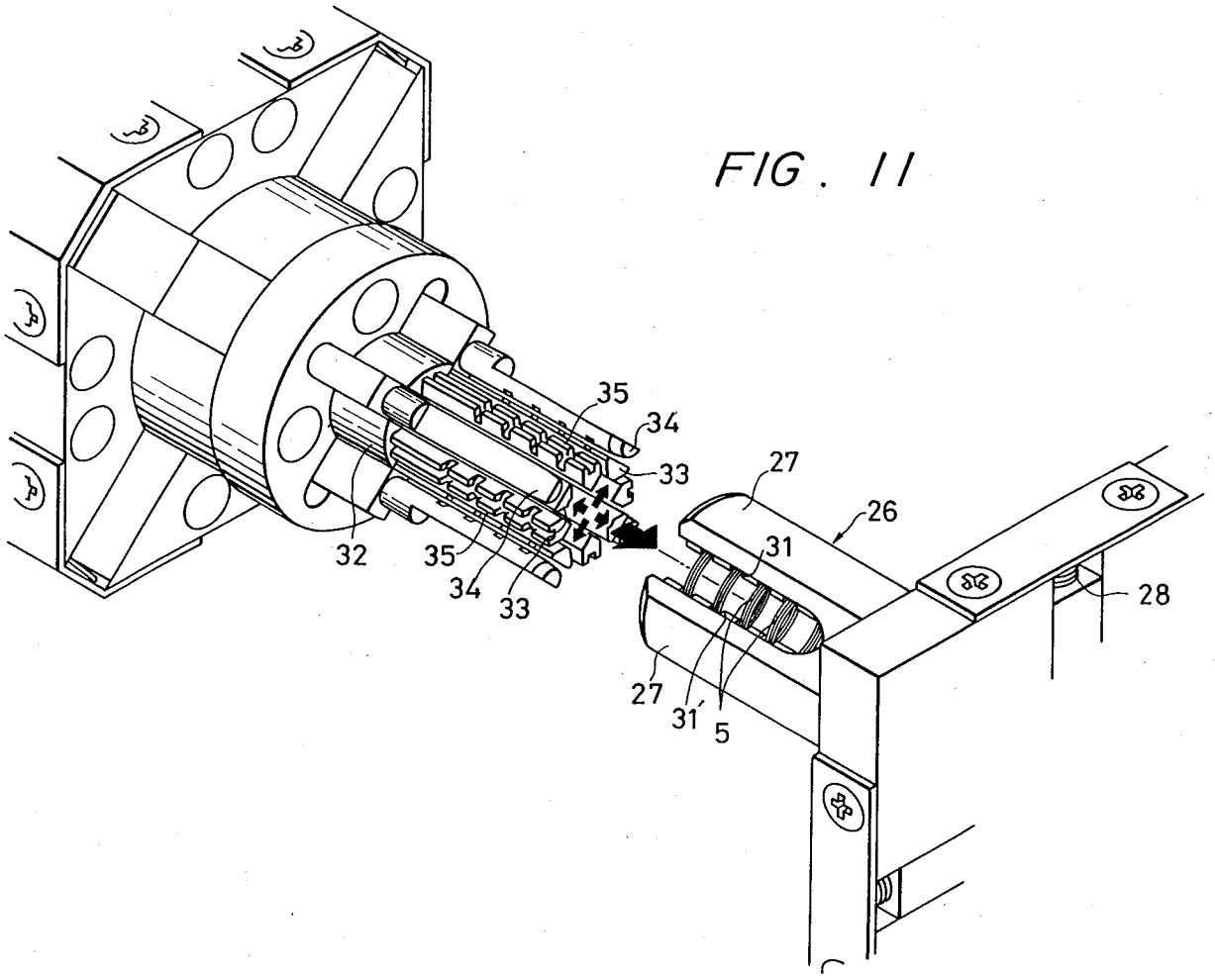

In the next place, as illustrated in FIG. 11, a coil-deforming shaft 32 is inserted into the coil holder 26. The coil-deforming shaft 32 includes inside finger bars 33 and outside finger bars 34, whose number are equal to the number of deformed portions of each of the coils 5, pairs of which are arranged to grip, for example, four portions of each of the coils 5 held by the coil-gripping jaws 27. Also included is a coil-holding member 35 for holding the coil 5. The inside and outside finger bars 33 and 34 are respectively arranged to be movable in the radial direction of the coils, and are respectively inwardly biased by means of unshown springs and are moved outwardly in response to the actuation of an unshown pushing member. On the other hand, the coil-holding member 35 is positioned to match the portions of the coils 5 which are not deformed, as clearly illustrated in FIG. 11. The coil-deforming shaft 32 is inserted into the coil holder 26 in the condition that the inside and outside finger bars 33 and 34 are respectively spread outwardly, so that the pairs of the finger bars 33 and 34 put the portions of the coils 5 to be deformed therebetween. In this condition, the actuation of the pushing member is released and the finger bars 33 and 34 are in turn moved inwardly by means of the biasing forces of the springs so that the coils 5 are deformed into substantially cross configuration. This is clearly seen from FIGS. 12 and 13. The cross coils are indicated by the reference numeral 13 in the figures. Each of the outside finger bars 34 has recess portions 34*a* whose number is equal to the number of the coils 5 (or 13), and each of the recess portions 34*a* partially receives each of the coils 13 therein when they are deformed, as shown in FIG. 14. The non-deformed portions 13*a* of the coils 13 are positioned and held by the coil-holding member 35 and the deformed portions 13*b* are positioned and held by the outside finger bars 34. This results in no discrepancy in terms of position and accurate deformation.

Since the coils 13 are reduced in circumscribed circle diameter as a result of the deformation, it is possible that the coil-deforming shaft 32 pulls out the coils 12 from the coil holder 26 as it is.

Figure 15:
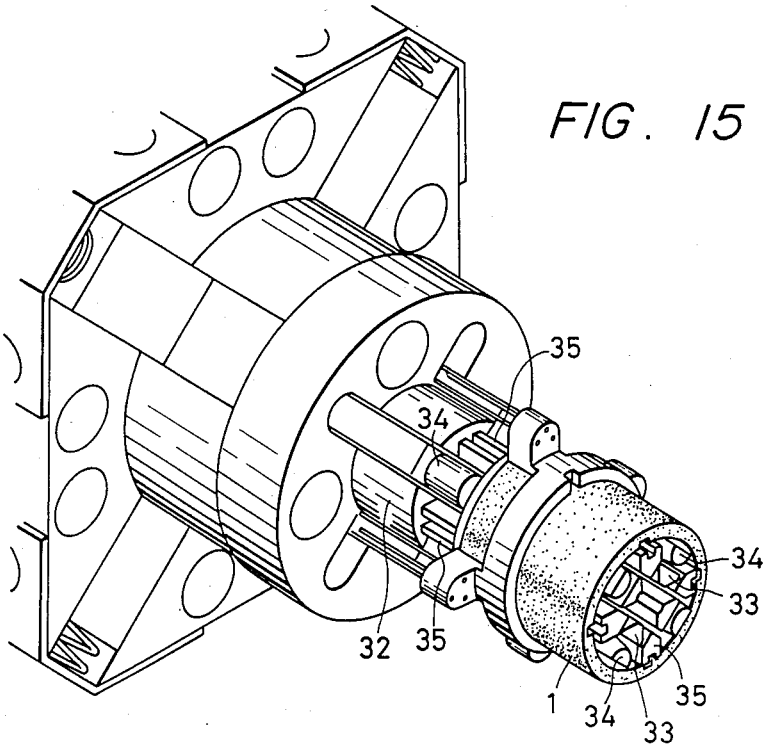
Figure 16:
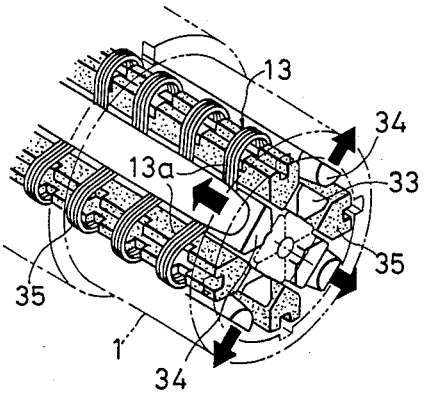
Figure 17:
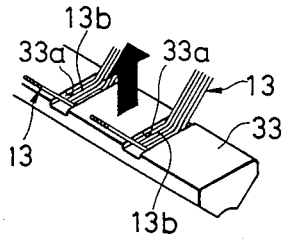

After the pulling-out of the coils 13, the coil-deforming shaft 32 is inserted into a cylindrical core 1 as shown in FIG. 15 and then the inside finger bars 33 and the outside finger bars 34 are respectively concurrently moved outwardly as illustrated in FIG. 16. As a result of the outward movements, the deformed portions 13*b* are pressed outwardly and the coil circumscribed circle diameter is enlarged. As well as the outside finger bars 34, the inside finger bars 33 has recess portions 33*a* which receive the deformed portions 13*b* of the coils 13 as shown in FIG. 17, resulting in no discrepancy in terms of the positions.

Figure 18:
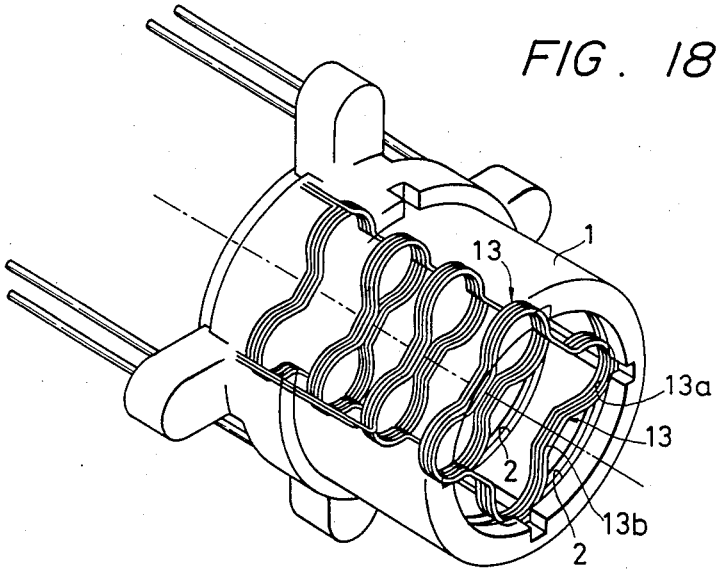
Figure 19:
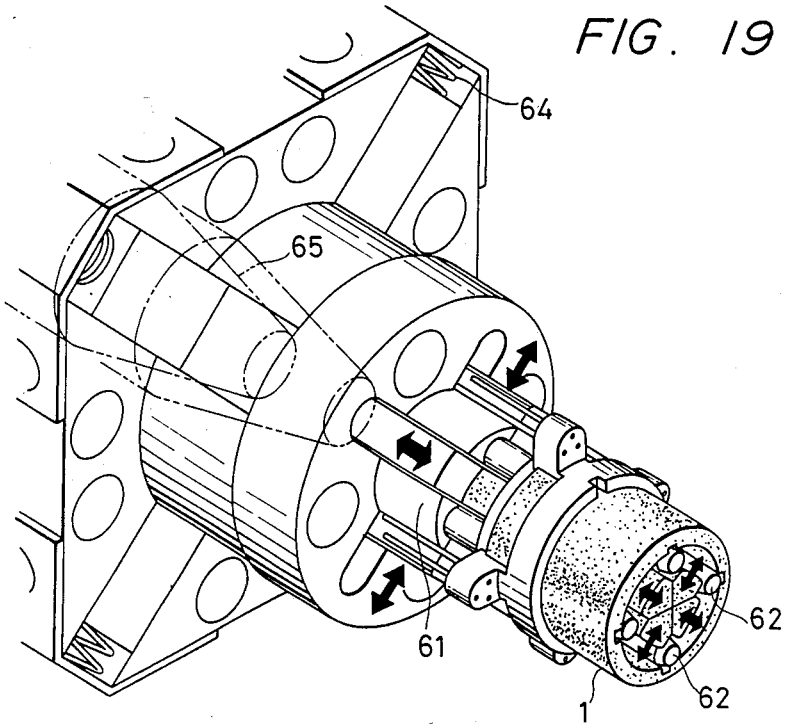
Figure 20:
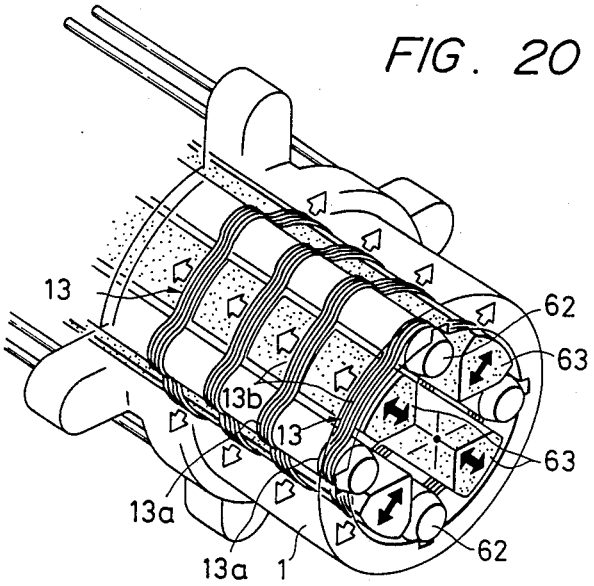
Figure 21:
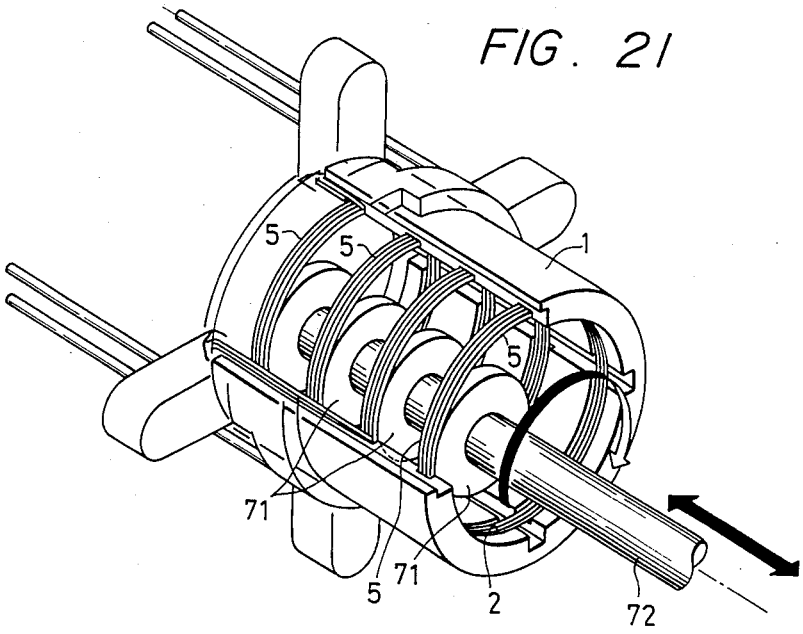

Thus, as clearly shown in FIG. 18, the non-deformed portions 13*a* of the coils 13 are respectively fitted in the coil channels 2 defined in the inner circumference surface of the core 1. Thereafter, the coil-deforming shaft 32 is removed form the core 1, followed by inserting a coil-enlarging shaft 61 into the core 1 as shown in FIG. 19. The coil-enlarging shaft 61 includes supporting shafts 62 for maintaining the positions of the non-deformed portions 13*a* in the channels 2 and enlarging finger bars 63 for pressing the deformed portions 12*b* thereof outwardly radially in order to further enlarge the coils 13. The enlarging finger bars 63 are respectively movable radially, i.e., outwardly and inwardly, and biased inwardly by means of springs 64. The outward movement thereof is achieved against the the biasing force of the springs 64 in response to the actuation of a pushing bar 65, and enlarges the deformed portions 13*b* of the coils 13 as large as possible as illustrated in FIG. 20. Thereafter, in place of the coil-enlarging shaft 61, a coil-fitting shaft 72, having rollers 71 whose number is equal to the number of the coils 13, is inserted into the core 1. The rollers 71 are rotated with the rotation of the coil-fitting shaft 72, whereby the coils 13 are respectively pressed to the bottom surfaces of the coil channels 2 and perfectly fitted therein.

While the present invention has been particularly shown and descibed with refernce preferred emboidments thereof, it will be understood by those skilled in the art that the foregoing and other changes in form and details can be made therein without departing from the spirit and scope of the invention.

What is claimed is:

1. A method for fitting a ring coil in a substantially circular channel radially formed in an inner circumferential surface of a hollow cylindrical member, comprising the steps of:

deforming said ring coil by applying a force radially inwardly to one or more portions thereof so that the circumscribed circle diameter thereof becomes smaller;

inserting the deformed coil into said hollow cylindrical member;

pressing the deformed portions of the deformed coil outwardly after positioning the deformed coil to match said channel so that the circumscribed circle diameter thereof is enlarged and the non-deformed portions of the deformed coil are fitted into said channel; and rotating roller means along the channel so as to press the deformed coil to the bottom surface of the channel all around so that the deformed coil is substantially restored to its original configuration and the whole of said ring coil is substantially entirely fitted therein.

2. A method as claimed in claim 1, further comprising a step of bonding the turns of said ring coil to each other.

3. A method for manufacturing an electrical part with a plurality of ring coils, said electrical part having a hollow cylindrical member and said plurality of ring coils being respectively fitted in a plurality of circular channels radially formed in an inner circumferential surface of said member, comprising the steps of:

concurrently deforming said plurality of ring coils by applying a force radially inwardly to one or more portions of each of said plurality of ring coils so that the circumscribed circle diameter thereof becomes smaller;

inserting the deformed coils into said hollow cylindrical member;

pressing the deformed portions of each of the deformed coils outwardly after positioning the deformed coils to match said channels respectively so that the circumscribed circle diameter thereof is enlarged and the non-deformed portions of each of the deformed coils are fitted into the corresponding one of said plurality of channels; and rotating roller means along the channels so as to press the deformed coils to the bottom surfaces of said channels all around so that the deformed coils are substantially restored to their original configuration and the whole of said ring coils is substantially entirely fitted therein.

4. A method as claimed in claim 3, further comprising a step of bonding the turns of each of said plurality of ring coils to each other.

* * * * *